United States Patent [19]

Fairbanks, Jr.

[11] 4,027,401

[45] June 7, 1977

[54] METHOD AND STRUCTURE FOR CURING AND/OR TREATING WOOD

[76] Inventor: John B. Fairbanks, Jr., 3927 S. 3030 East, Salt Lake City, Utah 84111

[22] Filed: June 23, 1975

[21] Appl. No.: 589,069

[52] U.S. Cl. ..... 34/16.5; 34/92

[51] Int. Cl.[2] ..... F26B 5/04

[58] Field of Search ..... 34/16.5, 13.4, 9.5, 34/15, 92

[56] References Cited

UNITED STATES PATENTS

| | | | |
|---|---|---|---|
| 116,969 | 7/1871 | Lear | 34/16.5 |
| 231,783 | 8/1880 | Flad | 34/16.5 |
| 1,721,297 | 7/1929 | Goodall | 34/16.5 |
| 2,387,595 | 10/1945 | Luth et al. | 34/16.5 |

*Primary Examiner*—John J. Camby

[57] ABSTRACT

Apparatus and process for curing and/or treating wood items such as logs and cut lumber. In one form of the invention a baffle is medially interposed in a closed chamber, separating such chamber into positive and negative pressure compartments, such baffle clamping to the lumber to be cured. A vacuum pump applies pressure to one compartment within the vessel and vacuum to the remaining compartment of the vessel, for the purpose of aiding with the withdrawal of resin from the wood. A resin solvent or diluent is introduced at the pressure side for rendering less viscous the resin contained in the lumber, to thereby aid in its travel through and withdrawal from such lumber. The return circuit to the vacuum pump includes a resin collector and also a water-moisture trap. Other fluid additives such as fireproofing and anti-rotting fluid materials may be introduced in the pressure side of the vessel. In a second embodiment, a tree trunk is held vertically in the field at the situs of its cutting and is supplied vacuum and pressure for curing and/or treating such trunk as a log prior to transport. In a third embodiment of the invention centrifugal force is relied upon to aid in the recovery of the resin from lumber or logs being cured.

20 Claims, 8 Drawing Figures

METHOD AND STRUCTURE FOR CURING AND/OR TREATING WOOD

The present invention relates to lumber-curing apparatus and the processes and, more particularly, to a new and improved apparatus and process which are useful in withdrawing resin and other moisture from logs, tree trunks, or cut lumber, and, optionally, which are useful to color or otherwise condition the fibrous constituency of the lumber.

In the past, the subject of curing and seasoning wood has been given considerable attention. Present methods of seasoning lumber generally involve subjecting lumber or logs to a heated gaseous environment as in an autoclave structure. This is a very time-consuming method for drying and thus seasoning timber for structural or other uses.

Another approach is shown in U.S. Pat. No. 231,783 wherein air is forced through timber by pressure. The air sometimes is desiccated, containing or being subject to calcium chloride, sulphuric acid or other suitable material that will absorb moisture of air. In such processes, the air is dried before passing it through the timber as by heating it or bringing it in contact with some material having a strong affinity for moisture as to withdraw it from the air. Thus, such process and apparatus pertains to the introduction of dried air, generally heated, through the pores of the wood to cure the interior of the same.

The present invention includes several important concepts. One is the provision of an evacuation chamber incorporating a single baffle useable in defining both pressure and vacuum compartments within such chamber. Broadly, a single vacuum pump is used both to exhaust air from one portion of the chamber and then to reintroduce the same air or gaseous media into the pressure side of the vessel. There are also provided traps for recovery of resins and also a water-moisture from the air current passed through the log or cut timber. Most importantly, the direction of flow is from the fine pore structure of the log to the coarse pore portion, that is, from the top of the trunk in the direction toward the base thereof. Likewise importantly, a resin solvent or diluent such as alcohol, acetone, or carbon tetrachloride, is employed on the pressure side of the vessel or, in other words, at the pressure end of the log, to tend to thin, i.e. render less viscous, the resins contained in the log, so that the air-pressure differential provided by the vacuum pump employed will have its greatest effectiveness in drawing resins and other moisture from the log. Such a solvent or diluent is employed at the pressure side and flows from the small pore cross-section of the log or timber to the large pore area at the butt thereof. Centrifugal force can also be relied upon in accelerating a withdrawal of resins and other moisture from the log. Likewise, provision is made for the actual curing of a tree trunk while the same is in its vertical position at the site of cutting and limb stripping. Thus, materials may be used to cure and/or treat the log in the field.

As to treating or coloring, various standard fireproofing liquids or gasses, dyes, or other impregnation materials may be employed once the resin extraction process by the pressure-differential, diluent step has been completed. Various types of wood preservance, fire retardant, and coloring agents as well as other types of impregnation materials are set forth in U.S. Pat. Nos. 2,650,885 and 3,685,959, which are fully incorporated herein also by way of reference. Thus, the impregnation or coloring of the cellulosic content of wood items, be they logs or cut lumber, is possible and in many cases desirable, but only after the resin has been removed by the pressure-differential technique suggested herein, in combination with the likewise-suggested thinning of the resins as by addition of alcohol, carbon tetrachloride or acetone, by way of example, during the vacuum-draw process.

Accordingly, a principal object of the present invention is to provide a new process for extracting resin from wood, so as to cure or season such wood.

An additional object of the invention is to provide a process for during and thus seasoning wood in a minimum amount of time.

A further object is to provide a method and also a process for treating wood to achieve any one of a number of desired characteristics.

A further object is to provide a wood treatment chamber wherein a single baffle separates such chamber into positive pressure and negative pressure compartments, whereby to apply pressure-differential across such wood so as to aid in the extractive process of resin therefrom.

A further object is to provide a new and improved method and structure for treating and for extracting resins from wood, which utilizes the addition of a diluent at a positive pressure area for flowing such diluent into the wood to thereby thin the resins contained therein, for quick and direct removal thereof at a negative pressure area.

A further object is to provide a means for seasoning and/or treating wood in the forest immediately after the same is cut and held in a vertical position.

A further object is to provide a means for utilizing centrifugal force in aiding in the extraction of resin from lumber.

A further object is to provide in a wood curing system, a means for trapping resin and water moistures separately, from the moisture extracted from lumber.

A further object is to provide a single vacuum pump means in a wood treatment system, wherein such vacuum pump supplies both positive and negative pressures at opposite ends of the wood being acted upon.

A further object is to provide end wood seasoning apparatus of the pressure-differential type, means for trapping recovered liquid and moisture, such as resin and water, and also means for introducing into the gaseous flow stream, a suitable resin-solvent and also a suitable wood dye.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

Figure 1:
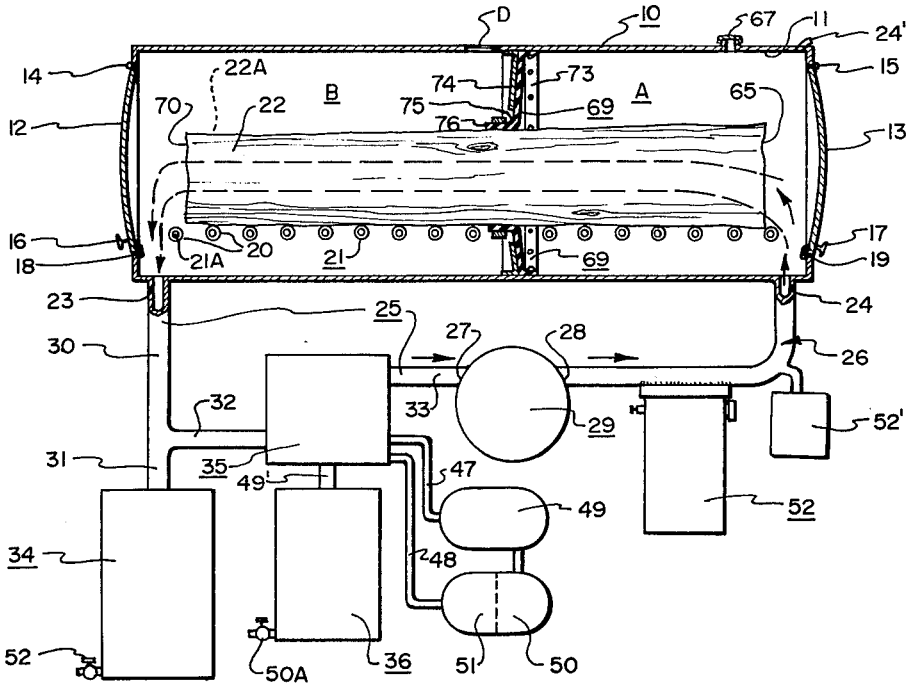
FIG. 1 is a schematic drawing, incorporating a view shown partially in section, of a process apparatus used in a first embodiment of the invention for extracting resin and other moisture from wood, such apparatus incorporating a solvent or diluent addition for application to the pressure side of the apparatus.
Figure 4:
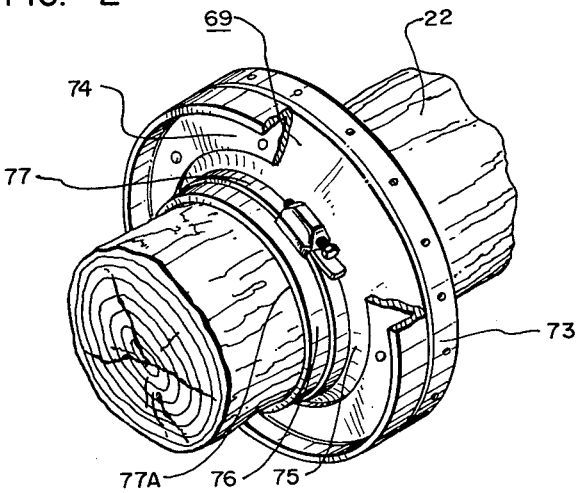

FIG. 4 illustreates in vertical cross-section a venturi-actuated vessel or cup which is utilized for the purpose of drawing a solvent or other liquid therefrom into the positive gaseous pressure flow of the system of FIG. 1.

Figure 5:
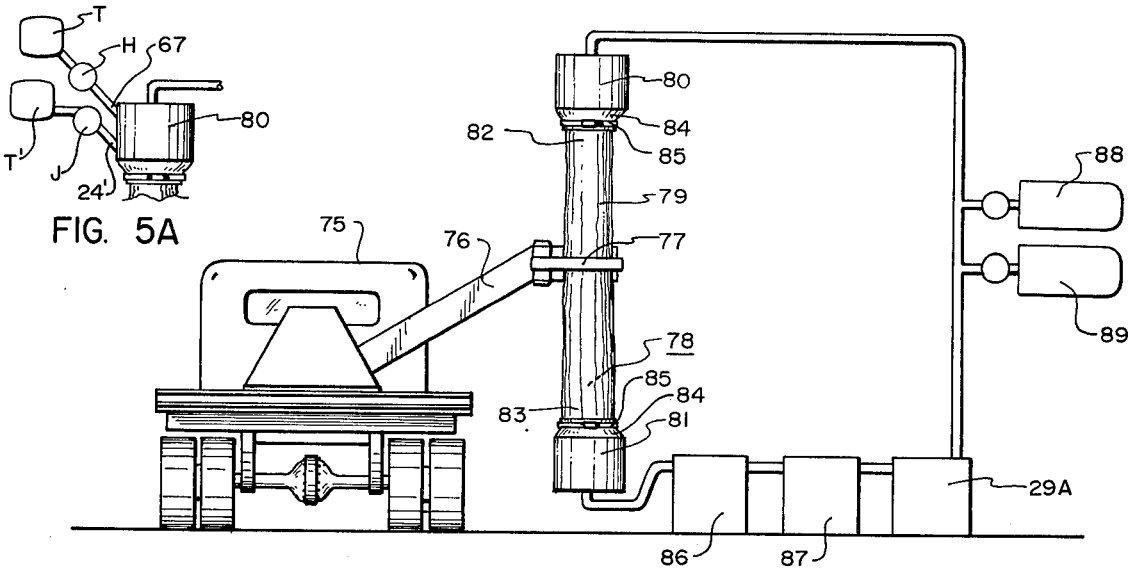

FIG. 5 is an elevation showing field or forest equipment holding a wrapped log in a field just after limb-stripping and trunk severence, whereby the pressure-vacuum system of the invention is applied to cure and-/or treat the log in the field at its situs of cutting.

FIG. 5A is a fragmentary view showing a gravity flow fluid system in connection with the upper log cap of FIG. 5.

Figure 6:
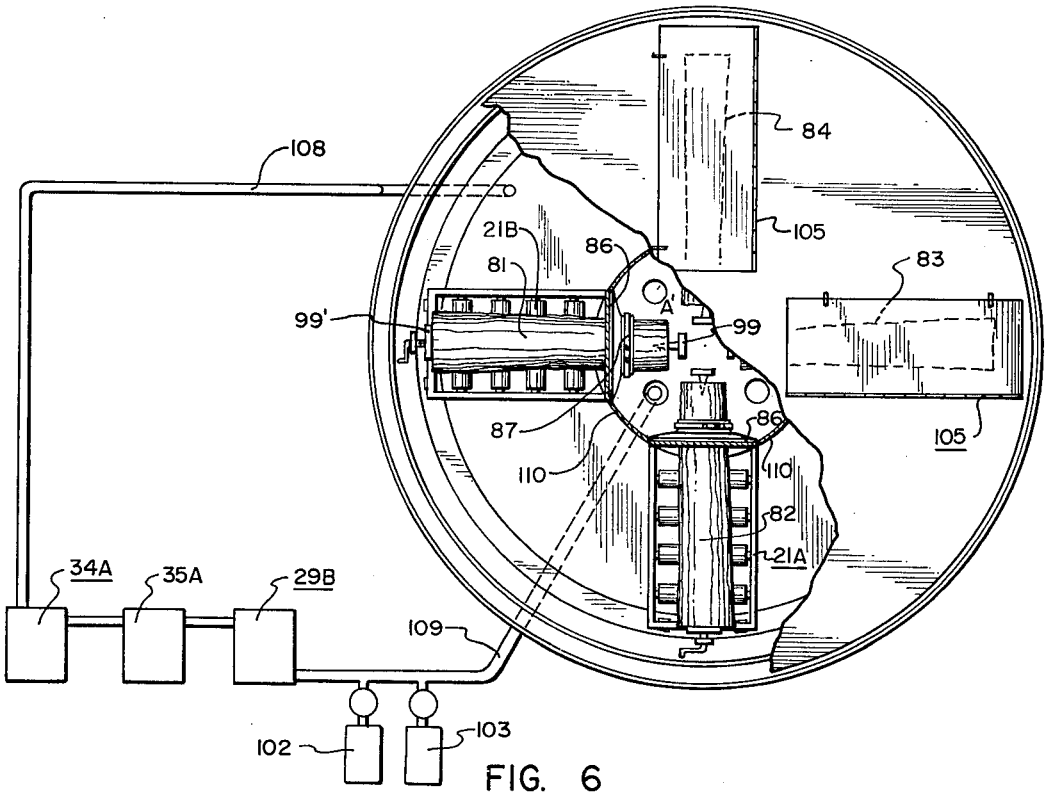

FIG. 6 is a plan view and is partially broken away, illustrating structure applying centrifugal force to horizontally disposed radial logs, whereby to aid in the solvent extraction of resins from such by the vacuum process described.

Figure 7:
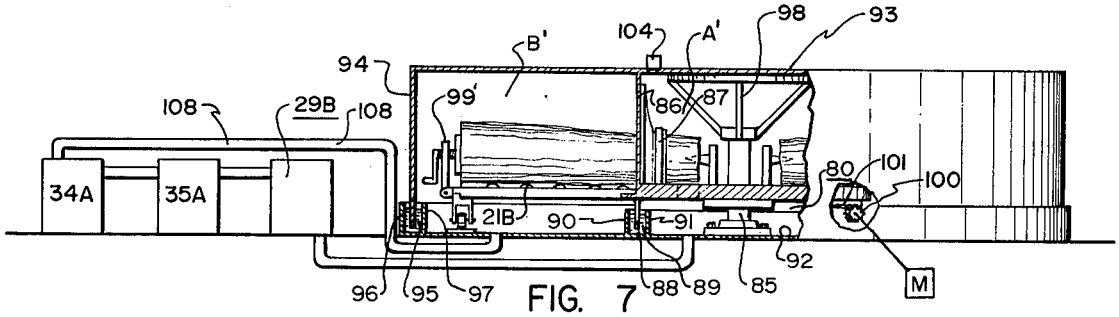

FIG. 7 is a side elevation of the structure shown in FIG. 6, illustrating the securement means employed whereby logs may be maintained in position while their support is spun or rotated about a central vertical axis.

It will be noted in the several embodiments described hereinafter that a central concept thereof resides in the provision of a diluent or solvent that is useful in reducing the viscosity of wood resins so that the same can be easily withdrawn from wood under applied pressure differential.

The apparatus of the present invention is shown to include a structure 10 which defines a chamber 11, preferably of rigid steel construction. Chamber 11 includes a pair of access doors, namely a first access door 12 and a second access door 13, which are respectively hinged at 14 and 15 to provide sealed closures via handles 16 and 17, and gaskets 18 and 19. A series of revolvable rollers 20 comprise a bed 21 for receiving wood items such as logs 22. These rollers 20 may be journaled by suitable bearing means on shafts 21A that are welded or otherwise secured to opposite sides of the tubular chamber 11.

Vacuum and pressure ports 23 and 24 are provided, and to these are connected negative and positive pressure lines 25 and 26, respectively, as indicated. These negative and positive pressure lines thus ultimately communicate with ports 27 and 28 of vacuum pump 29.

Negative pressure line 25 may in face comprise a series of portions as at line portions 30, 31, 32, and 33. These are useful to interconnect the resin collector 34 and water collector 35, with its sump 36, to the vacuum pump 29.

Figure 2:
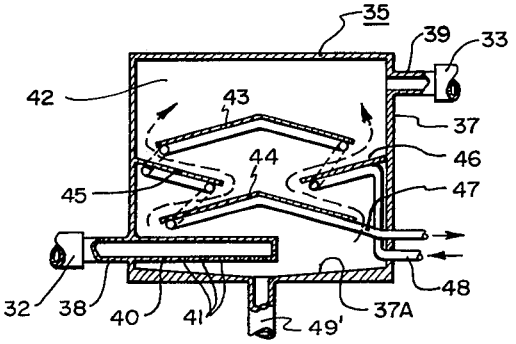
FIG. 2 is an enlarged, fragmentary, perspective view of the central baffle area of the pressure-vacuum chamber of FIG. 1.

FIG. 2 illustrates the water collector 35 as comprising a vessel 37 having inlet and outlet ports 38 and 39. Port 38 includes an interior pipe 40 which is perforate at 41 for the purpose of emitting fluid vapors thereat through the interior 42 of the vessel 37. Disposed within such interior will be a series of condensation plates 43, 44 and 45 and 46 which are angularly disposed and mutually spaced such that vapors may ascend in a direction of the dotted lines shown in FIG. 2.

The plates 43–46 are cooled by coolant flow conduits 47 and 48 leading to condenser 49 and reservoir 50, on the input side of pump 51 in FIG. 1.

Accordingly, any water moisture or water vapor that is entrained in the air stream ascending upwardly in the direction of the arrows in FIG. 2 will condense on the surface of the several plates indicated at 43–46 such that droplets will descend, collecting at bottom 37A and proceeding out drain pipe 49' to sump 36. The latter will be periodically drained by drain valve 50A as seen in FIG. 1.

In considering the resin collector 34 itself, the same may be simply a storage vessel provided with drain valve 52 that can be manually operated. The pump, condenser and reservoir structure at 49–51 will be suitable for providing any coolant liquid such as water under ambident or refrigerated temperature conditions for keeping the plates 43–46 cool. Ice water can be circulated, or indeed, the unit comprising elements 49–51 may comprise a conventional refrigeration unit, incorporating a compressor in lieu of the condenser at 49.

Any of several types of vacuum pump may be incorporated at stage 29. The vacuum pump need not be one that is run at especially high negative pressures; 15–20 inches of mercury will satisfy for the vacuum applied by the pump which, as seen, communicates via vessel 35 to vacuum port 23 of chamber 11.

To the right of vacuum pump 19 in FIG. 1 is shown a solvent supply vessel 52. This may take any one of several forms but can include a venturi portion 53 having mount 54 to which is connected a depending container or cup 55. The latter is filled with a suitable solvent such as alcohol, by way of example, which is designated at 56. An atmospheric pressure port valve 57 can be included as well as cap 58. The venturi at 53 is threaded or otherwise secured to end connectors 59 and 60 where the line 26 comprises a pair of communicating segments 61 and 62. Depending tube 63 is a venturi tube leading to the venturi portion 64 of the unit in FIG. 3.

Accordingly, the pressure side of vacuum pump 29 accepts air and passes the same under pressure to pressure port 24. In doing so, the venturi structure of vessel or cup 55 will draw upwardly the resin diluent or solvent fluid contained, e.g. alcohol, acetone, or carbon tetrachloride, therein so as to supply a stream of solvent plus air coming into port 24.

Of course, there will be other ways of subjecting the end 65 of log 66 to a tree-resin solvent, dye or other fluid material. One way will be simply to pour fluid into port 67 and subject the same to the pressure of vacuum pump 29 for introducing the solvent of dye to the outer surface of the log to the right of the baffle 69, especially to end 65. From the opposite end 70 of the log or other timber item, there will be vacuum-withdrawn air, moisture, and resin-entraining solvent, so that the same is "sucked" or drawn downwardly through port 23.

FIG. 4 illustrates the log 22 as being provided with a medial baffle 69, see FIG. 1. This baffle may include a ring 73 and also a stiffener plate means 74 that backs on one or both sides of the elastomeric diaphragm 75 of the baffle. The latter diaphragm includes an elastomeric ring 76 which is clamped by a conventional clamp means 77 to the log in a sealing engagement therewith. For these purposes the elastomeric ring should be thick and preferably made of a closed-pore sponge rubber. Accordingly, the central opening 77A of the composite baffle serves to admit the log 22 and the latter may be essentially of any diameter, owing to the structural nature of the baffle within ring 73.

The structure as thus far described operates as follows. Central to the concept of the invention is the provision of the apparatus or structure 10 which supplies chamber 11. Chamber 11 is, in fact, comprised of compartments A and B, separated by air-impervious baffle 69. Compartment A is thus a pressure compartment and compartment B an evacution or negative pressure compartment.

Preliminarily, the first access door 12 will be opened and the log or other piece or pieces of lumber or wood will be introduced at 22A over bed 21 comprising rollers 20. Access door D may be provided as manual access for securing the clamp 74, so that the elastomeric ring 76 receiving log 22 will engage in an air-tight relationship of such log or lumber, or wood piece. At this point the vacuum is turned on so that there will commence a flow of air from right to left of air in the log and within the compartments A and B.

A solvent will be introduced either as a liquid at port 67, or as a vapor by virtue of solvent supply vessel 52, so that either liquid solvent or solvent droplets entrained in the air stream will be carried in pressure-relationship with end 65 of log 22. Again, the solvent may be introduced into the port 67 in a liquid form and pressure simply applied the liquid. In such event part 24 will be located at 24' so that the air pressure will force the liquid against and into end 65 and perhaps also into the peripheral area of the log as well.

The solvent in entering the pores will tend to dissolve the resins inside the log or cut lumber and these will carry toward end 70 of the log in a very rapid manner, this such that the log or lumber treated will be made essentially free of resin in a manner of but a few minutes.

Subsequent to this, the air may be circulated through the log via vacuum pump 29 until the log is completely dried out. Optionally, there may be additionally applied a liquid dye, fire-proofing, or other agent into port 67 such that this may be run through the log via vacuum pump 29.

As air and moisture proceeds downwardly in the direction of the arrows to the right in FIG. 1, the resin droplets will descend downwardly and be collected in collector 34. Moisture such as water vapor will be carried into collector 35 and there condensed by the cooled plates 43–46, such that these materials will drop out into sump 36.

What is provided, therefore, is a structure and process by which a log, a piece of wood, or several pieces of wood at 22 may be quickly cured, and this by a single vacuum means such as a single vacuum pump drawing air out of one chamber B and introducing the same under pressure in chamber A. In all this time the air may be circulated dry, and then may entrain a solvent, or a solvent may be simply introduced at 67 or 24' so that the vacuum pump will force the liquid present in chamber A through the log to tend to dissolve and make less viscous or flowing the fluid within the log.

It is important to note that the upper part of a log near its top is less porous, i.e. has finer pores, than the lower part of the log near its root system. Accordingly, when a log is topped and when the roots are cut off near the trunk space, then the larger part of the log, having the most porous section, should be disposed in chamber B such that the large pore portion of the log nearest its former root system will be disposed at 70. Thus, as the solvent carries the resins through from the fine grain or fine pore portion of the log, namely, the flat end portion of 65 in FIG. 1, and the fluid circuit continues from right to left in FIG. 1 to the large pore area at end 70. Thus, build-up of resins and solvent can be easily transported through the progressively more porous structure of the tree. Where desired, of course, a unit 52' may incorporate a dye to be carried by the air stream on the pressure side of vacuum pump 29 to compartment A.

As to FIG.5, there is presently existing field machinery or equipment which clampingly grasps a limb-stripped tree trunk while the root system thereof is still intact, and which supports the trunk for transverse cuts made to sever the top and the base of the tree from the suspended trunk, see FIG. 5. Such equipment is now standard logging equipment and is shown at 75 in FIG. 5. The same will include the usual arm 76 and clamping jaws 77 which support the tree trunk in a vertical position. Preliminarily, and after the severing of the branches, the trunk 78 can be wrapped with an essentially air-impervious material 79 as, for example, polyethelene sheeting. Steel caps 80 and 81 are disposed over the opposite ends 82 and 83 of the log and are each supplied with an elastomeric baffle 84 and clamping means 85 similar to the structure shown in FIG. 2. This will, of course, exist at both ends of the supported log or trunk. Resin and water separators at 86 and 87, corresponding to the structure at 34 and also the structures at 35, 36, 49, 50 and 51, will exist and are shown simply in schematic block form in FIG. 5 as respective structures 86 and 87. These lead again to vacuum pump 29A which corresponds to vacuum pump 29 in FIG. 1.

Additionally, a dye container 88 and a solvent container 89 may be provided, and both may take the form of the structure shown in FIG. 4 or, optionally, may be the separate liquid tanks, tank T and T' in FIGS. 5A, provided valves H and J, that are designed to communicate with ports 24' and 67 in FIG. 1, see also FIG. 5A. In any event, it is noted that the dye solution or solvent is introduced at the top at cap 80. Again, this is because the upper end 82 of the log has that transverse cross-section of finest or smallest port structure. Thus, as the solvent works its way down the log, by virtue of the vacuum pressure improved by vacuum pump 29A, then the resin, in accumulating toward the areas of greatest port size, will not clog therein but will tend to be drawn downwardly into cap 81, there to undergo a separation of resin in tank 86 and water in tank 87. In lieu of the wrapping at 79, the bark of the log may be relied on to add some imperviousness relative to radial air passage through the log from the atmosphere.

Accordingly, FIG. 5 illustrates structure by which a log can be cured in a field in just a few moments time, even before the log has been removed from its cutting site.

FIGS. 6 and 7 illustrate an alternate form of the invention wherein a rotating platform 80 is employed to support a series of logs 81,82,83 and 84 in a mutually radially-oriented configurement. The support 80 or table is rotatably supported centrally for rotation, and thus is supported by a post 85 and suitable thrust bearings, not shown. Baffle 86 in FIG. 7 is clamped by clamping means 87, and takes the form similar to that shown in FIG. 2. The rotating table or support will be supplied a depending annular flange 88 travelling in an oil seal 89 formed of adjacent rings 90 and 91. These rings form a part of and are upstanding from base 92. Cover 93 secures a representative baffle 86 in place and includes an annular depending flange 94 which rides in an oil seal 95 composed of upstanding rings 96 and 97. In fact, the cover 93 will be stationary while the support carrying the logs will revolve with respect thereto. The cover may be supported by post 98 in a conventional manner. The bed 21B corresponding to roller bed 21 in FIG. 1 can be used to support all of the logs.

Centerpoint means 99 can be employed to secure the logs at their forward ends against transverse movement, and clamping structure 99' can be employed to secure the butt ends of the logs in place. Compartments A' and B' in FIG. 7 correspond to compartments A and B in FIg. 1. Accordingly, prime mover means M will couple to pinion 100, the same engaging ring gear 101 which is specifically mounted to the underside of support 80. It is this switch which rapidly revolves the unit about the axis of post 85. Rotational movement of support 80 produces a centrifugal force action that is helpful in aiding the rapid travel of resin and solvent from the "top end" of each log, proximate support 85, to the base or butt end thereof in a very rapid manner.

Vacuum pumps 29B in FIGS. 6 and 7 correspond to vacuum pump 29 in FIG. 1, and resin and water traps are provided at 34A and 35A corresponding to that shown in FIG. 1.

Either the pressure side of the vacuum pump may be imposed directly to area A', or there may be additionally supplied a solvent container 102 or dye container 103 as shown in FIGS. 5 and 1–3. Optionally, of course, the solvent or dye may be simply poured into area A' by port 104. Access doors 105 can be employed in a releasable, sealing manner, by conventional handles and sealing structure, for obtaining access to the log area for the purpose of securing the baffles 86 with their clamps 87 in place.

Accordingly, as to the structure in FIGS. 6 and 7, the logs are first positioned and their pressure and negative-pressure isolation compartment baffles secured in place in the manner shown in FIG. 6, corresponding to that indicated in FIG. 2. This will be done at each log location, by virtue of one or more access doors 105. Then the support structure 80 is rapidly rotated about the post 85, this by means of prime mover end pinion gear 100 and ring gear 101, so that the same travels rapidly over base 92 and underneath fixed cover 93. Oil seals are preserved at 98 and 89 so that there will be no leakage at each of these points. As the support structure at 88 continues to whirl around, any sap or resin present, as well as any moisture, will be urged rapidly from the top end to the butt end of each log, to be exhausted in area B' and carried from thence by evacuation pressure by conduit 108 to the resin trap at 34A, water vapor trap 35A, and ultimately to vacuum pump 29B.

A plurality of sealing walls 110 join the several baffles 86, see FIG. 6, to form a sealed positive pressure compartment A'. To the latter is connected conduit 109 which proceeds from the positive pressure side of vacuum pump 29B.

What is provided in FIGS. 6 and 7 hence, is a rapidly rotating structure wherein cure time is even further reduced, by virtue of using centrifugal force to aid in forcing resin and other moisture from tree trunk logs or cut lumber.

Figure 3:
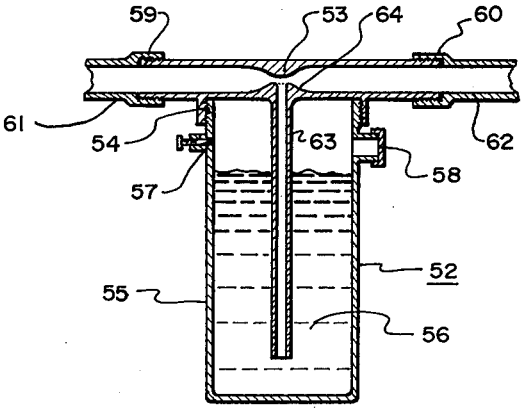
FIG. 3 is an enlarged vertical cross-section of the water moisture collector of FIG. 1

Relative to FIGS. 1 and 3, the unit 52' containing dye, fire-retardant liquid, or other means, may take the form of solvent-containing unit 52, shown in FIGS. 1 and 3. The term "moisture" as used herein shall be understood to refer not only to water moisture but also to resins and any other tree moistures. Additionally, as to FIG. 7, member 98 may comprise a portion of certain support structure, as shown in FIG. 7, which is rigidly affixed to cover 93 and journalled to post 85.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. Apparatus for curing wood, including in combination, structure defining a chamber constructed to receive wood items of possibly varying girth, said structure including a sealable, selectably closable, first access door, a baffle transversely disposed within and secured to said structure, said baffle including manually adjustable, selectively radially expandable and radially contractible clamping means constructed for sealingly clamping peripherally about said wood items whereby to define pressure and vacuum compartments within said chamber on opposite sides of said baffle, said structure also being provided with vacuum and pressure ports on opposite sides of said baffle, gaseous pumping means for applying a gas-pressure differential across said vacuum and pressure ports, and means for collecting recovered wood moistures communicating with said vacuum port.

2. The apparatus of claim 1 wherein said gaseous pumping means comprises a single vacuum pump.

3. The apparatus of claim 1 wherein said baffle includes an elastomeric resilient central portion for engaging said wood item.

4. Apparatus for curing wood, including in combination, structure defining a chamber constructed to receive a wood item, said structure including a sealable, selectably closable, first access door, a baffle medially and transversely disposed within and secured to said structure, said baffle including means constructed for sealingly clamping peripherally about said wood item whereby to define pressure and vacuum compartments within said chamber on opposite sides of said baffle, said structure also being provided with vacuum and pressure ports, gaseous pumping means for applying a gas-pressure differential across said vacuum and pressure ports, and means for collecting recovered wood moistures communicating with said vacuum port, and wherein said apparatus includes means for revolving said wood item about a pivot point positioned on the longitudinal axis of and away from said wood item.

5. The apparatus of claim 1 wherein said structure includes a bed means of aligned rollers for supporting a wood item within said chamber.

6. The apparatus of claim 1 wherein said apparatus includes solvent supply means communicating with said pressure port.

7. The apparatus of claim 1 wherein said apparatus includes a treatment fluid supply communicating with said pressure port.

8. The apparatus of claim 1 wherein said apparatus includes a solvent supply and also a dye supply selectably communicating with said pressure port.

9. The apparatus of claim 1 wherein said apparatus is provided with a venturi-provided liquid vessel teed to and interconnected and communicating with said pressure port.

10. The apparatus of claim 1 wherein said structure is provided with a second access door opposed to said first access door, said structure being rectilinear and tubular.

11. The apparatus of claim 4 wherein said gaseous pumping means comprises a single vacuum pump coupled to and across said vacuum and pressure ports of said structure.

12. Resin removal apparatus including a negative pressure line, a positive pressure line, and a single vacuum pump operatively interposed therebetween, said negative pressure line being provided with a resin trap, said negative pressure and positive pressure lines each being provided with respective outer end structures constructed for coupling to the opposite ends of an external wood item.

13. The structure of claim 12 wherein said negative pressure line is provided with a liquid-cooled moisture trap.

14. Resin removal and wood treatment structure including, in combination, a single vacuum pump having a positive pressure port and a negative pressure port, respective positive pressure and negative pressure lines coupled to said ports, respectively, said lines each including application end structures, a liquid-additive means cooperatively associated with said positive pressure line, and liquid-removal means cooperatively associated with said negative pressure line.

15. A resin-extraction apparatus for the curing of wood including, in combination, a rotatable horizontal support for carrying wood items radially aligned thereon, means for pivotally rotating said support about a central, vertical axis, and means for applying fluid pressure to proximate inner ends of said wood items and for applying negative pressure to opposite ends of said wood items.

16. Apparatus for curing wood in the field, including, in combination, machine means having radially expandable clamping means for peripherally grasping and holding vertically a cut tree trunk in the field, first means for applying a negative pressure to one end of said tree trunk, and second means for applying positive pressure to the remaining end of said tree trunk, whereby to withdraw moisture from said tree trunk via said first means.

17. The apparatus of claim 16 wherein said second means is disposed above said first means.

18. Structure according to claim 16 wherein said apparatus includes means essentially impervious to air for wrapping said tree trunk prior to machine grasping thereof.

19. A process for during wood including the steps of: vacuum-pulling a fluid through a provided wood item in the direction of from a small pore cross-section to a large pore cross-section thereof; and collecting said fluid and any wood moistures carried thereby.

20. A process for removing resin from wood, including the steps of: providing a resin solvent; vacuum-pulling said resin solvent through a provided wood item; and collecting said solvent and resin carried thereby.

* * * * *

UNITED STATES PATENT OFFICE

CERTIFICATE OF CORRECTION

Patent No. 4,027,401 Dated June 7, 1977

Inventor(s) John B. Fairbanks, Jr.

It is certified that error appears in the above-identified patent and that said Letters Patent are hereby corrected as shown below:

Column 2, line 14, change "during" to --curing--;
Column 3, line 3, change "illustreates" to --illustrates--;
Column 3, line 48, change "face" to --fact--;
Column 4, line 10, change "ambident" to --ambient--;
Column 4, line 46, change "of" to --or--:
Column 5, line 37, change "proceeds" to --proceed--'
Column 6, line 32, change "FIGS." to --FIG.--;
Column 7, line 13, delete "switch"

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*